US005882043A

United States Patent [19]

Murphy et al.

[11] Patent Number: 5,882,043

[45] Date of Patent: Mar. 16, 1999

[54] ROOF DRAIN ADAPTER

[75] Inventors: Colin Murphy; Robert Mills, both of Seattle, Wash.

[73] Assignee: Exterior Research & Design, LLC, Seattle, Wash.

[21] Appl. No.: 943,292

[22] Filed: Oct. 14, 1997

[51] Int. Cl.[6] ..... E04D 13/00

[52] U.S. Cl. ..... 285/42; 285/915; 52/302.1

[58] Field of Search ..... 285/42, 43, 44, 285/915; 52/198, 302.1, 12, 14

[56] References Cited

U.S. PATENT DOCUMENTS

| | | | |
|---|---|---|---|
| 1,503,421 | 7/1924 | Innes | 285/42 |
| 2,275,628 | 3/1942 | Hirshstein | 285/42 |
| 2,672,205 | 3/1954 | McDonald | 285/42 |
| 4,850,617 | 7/1989 | Moberly | 285/42 |
| 5,526,613 | 6/1996 | Simeone | 285/42 X |

OTHER PUBLICATIONS

Brochure—Smith, 8 sheets, Jan. 12, 1994.

Brochure—RAC Roof Accessories Company, Inc., Feb. 1994, 11 pages.

Brochure—Josam, pp. 66–82, 1990.

Brochure—U–Flow Roof Drain Systems, Inc. Aug. 1987, 13 sheets.

Brochure—Zurn Industries, specification sheet, pp. RD1 to RD26, 1991.

*Primary Examiner*—Dave W. Arola

*Attorney, Agent, or Firm*—William Squire

[57] ABSTRACT

A square or circular apron formed of plastic coated disk-like sheet metal or fiber-metal reinforced synthetic material is bonded to a circular ring gasket having a surface conforming to the upper mating surface of an existing roof drain flange. Reinforcing rib depressions are formed in the apron outer region. The apron extends for a major radial extent beyond the periphery of the drain flange and with the gasket is clamped to the drain flange via existing bolt holes in the drain using stainless steel or bronze replacement bolts. Screws clamp the apron and the underlying roof membrane, which may be bonded to the apron to form a water tight seal, to the deck. A metal clamp ring may be used to clamp the apron and gasket to the drain flange. Various embodiments are disclosed.

19 Claims, 2 Drawing Sheets

Figure 3:
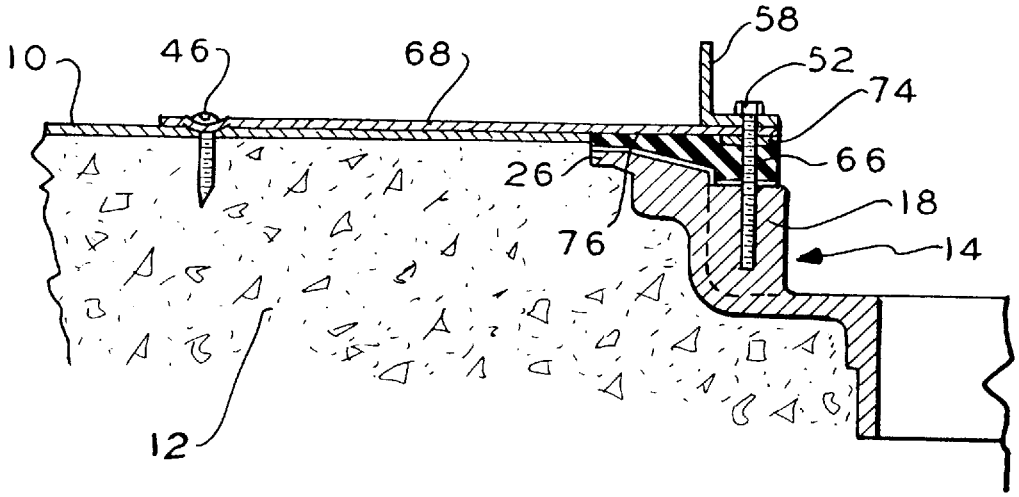

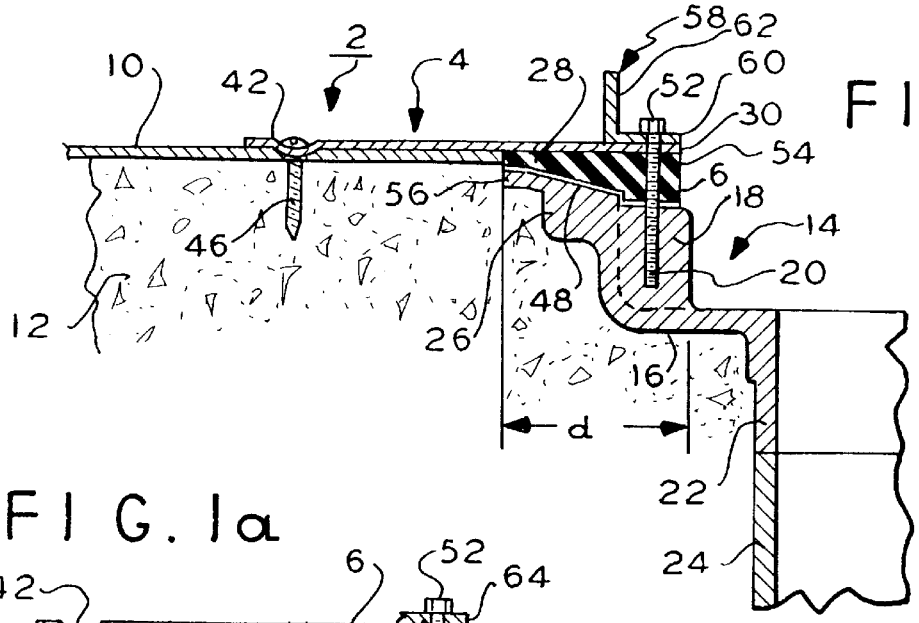
FIG. 1
FIG. 1a
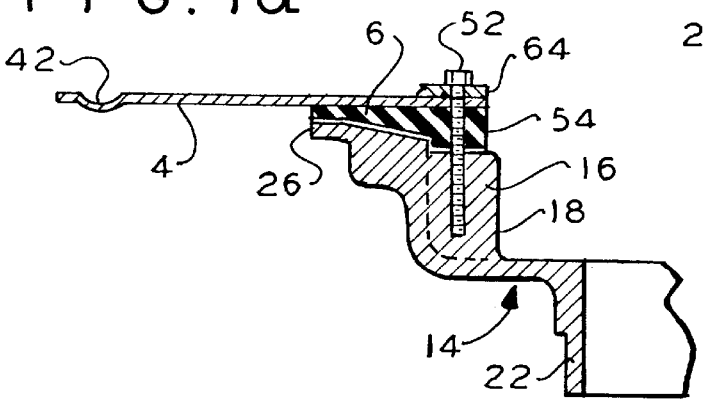
FIG. 2a
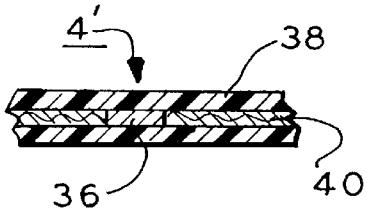
FIG. 2
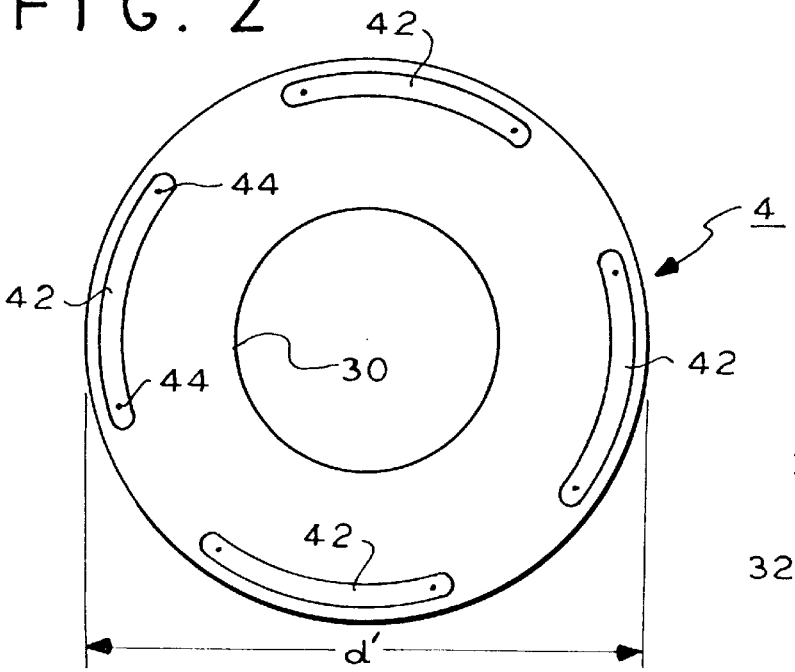
FIG. 2b
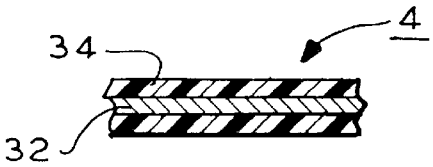

ROOF DRAIN ADAPTER

This invention relates to roof drain adapters for attaching a roofing membrane to a roof deck in a region adjacent to a roof drain.

Building roofs in certain configurations comprise cementitious, steel, lightweight concrete, or cementitious wood fiber substrate decks covered by a flexible waterproofing membrane. The membrane is typically fastened to the deck by special fasteners for use with such decks or may be bonded. The membrane is a relatively thin flexible sheet overlying the deck. The membrane is subject to ambient weather conditions such as wind loads and the like. The wind tends to lift any exposed loose edge of the membrane, and it is therefore important to insure the membrane is fastened securely to the deck.

Roof drains are typically set into roof decks. In roof decks employing what is referred to as single ply membranes, such drains present a problem. The membranes generally are not held securely at such drains by present fastening structures. Often, drains are cast iron and are used to clamp the membrane adjacent thereto to the deck. However, this arrangement is often not satisfactory. The membrane may slip out of the clamping arrangement when subjected to loading caused by environmental conditions, e.g., wind loading. The drain may also include a clamping ring for clamping the membrane to the drain at a flange thereof. The membrane is not usually held securely by such a clamping ring when subjected to loading conditions.

Lead, or other compressible material, may be secured to the drain flange at the clamping ring to create a compression load at the drain flange and ring. Four bolts in an annular array are used to clamp the ring and membrane to the drain flange. This arrangement has not resolved the clamping problems associated therewith.

The use of existing drains is common in attaching new roofing membranes to a roof deck. The old drain components are not always satisfactory for attaching the membrane to the deck and, thus, need to be rehabilitated in some way or replaced. This is costly, and in many cases, replacement parts are difficult to locate.

Drain inserts have been developed to fit into existing drains bypassing the drain. An internal drain sleeve is employed thereby reducing the size and flow capacity of the outlet pipe. The sleeve relies on friction between the sleeve's outer surface and the pipe inner surface to hold the drain in place. The friction fit can be defeated through exposure to dynamic vertical and oblique loading caused by wind loads.

The present invention is directed to a recognition of a need to provide a pre-fabricated component to be used in single ply membrane systems for securing the membrane at such roof deck drains.

A drain adapter according to the present invention for a drain in a roof deck, the drain including an annular flange of a given exposed surface configuration surrounding a central drain opening, the flange having an annular array of bolt receiving apertures, the deck including a flexible roofing membrane thereover surrounding and adjacent to the flange, the adapter comprising an annular compressible gasket having a first surface complementary to and for abutting engagement with the given surface and a second surface distal the first surface. An annular disk-like apron overlies and abuts the gasket second surface and extends radially outwardly from the gasket for overlying a portion of the membrane adjacent to the flange and gasket, the apron and the gasket for being clamped to the flange and the apron for clamping the membrane to the deck.

Adhering means may be used for bonding the apron member to the gasket second surface.

A plurality of annularly spaced reinforcing ribs or at least one reinforcing rib may also be included on the apron.

Preferably, the rib or ribs are depressions in the apron for receiving fasteners for attaching the apron to the roof deck.

In one aspect, the apron is sheet material with a central opening and is bonded to the gasket.

In a further aspect, an annular ring overlies the apron and the gasket adjacent to the opening.

In a still further aspect, the ring, the gasket and the apron each having a plurality of annularly spaced aligned holes each for receiving a corresponding bolt for attachment to a drain aperture.

The apron preferably comprises sheet metal with an outer coating layer or reinforced non-metallic sheet material wherein the reinforcement may comprise a material selected from the group consisting of steel and aluminum rings and carbon, polyester and glass fibers.

IN THE DRAWING

Figure 4:
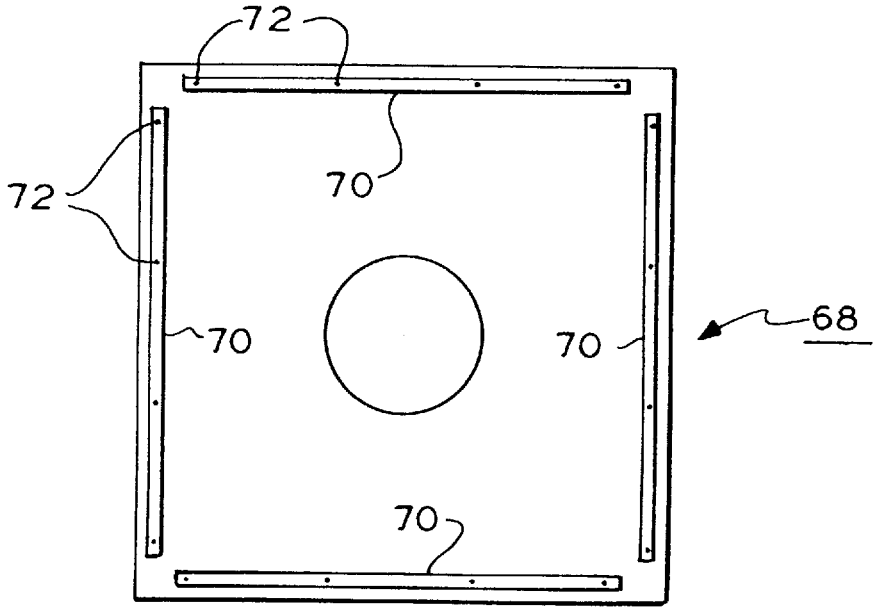

FIG. 1 is a partial elevation sectional view of a drain adapter according to one embodiment of the present invention;

FIG. 1*a* is a partial elevation sectional view of a second embodiment similar to the view of FIG. 1;

FIG. 2 is a plan view of an apron which used in the embodiment of FIG. 1;

FIGS. 2*a* and 2*b* are partial sectional elevation views of different embodiments of the apron of FIGS. 1 and 2;

FIG. 3 is a partial elevation sectional view of a drain adapter according to a further embodiment of the present invention; and FIG. 4 is a plan view of an apron which may be used in the embodiments of FIGS. 1 and 3.

In FIG. 1, adapter 2 comprises an annular apron 4, an annular preferably elastomeric gasket 6 and a clamping ring 8. The adapter 2 is for clamping a sheet of flexible roofing membrane 10 to a roof deck 12 which may be of any of the aforementioned materials mentioned in the introductory portion. Pre-existing in the roof deck 12 is a prior installed rain drain 14.

The drain 14 is typically one piece cast iron as employed in prior art roof deck installations, but may be other materials. The drain 14 comprises a circular bowl 16 including an annular array of bosses 18, typically four, containing threaded bolt receiving apertures 20. A central drain conduit 22 is coupled to a down spout pipe 24 for draining rain water from the roof deck. The drain 14 has an outer peripheral flange 26 with an inclined upper surface 28.

Membrane 10 is a flexible sheet of deck protective material of prior art composite construction. The membrane 10 typically is available in rolls and lain over the roof deck 12 in overlying lap edges (not shown). The membrane 10 is fastened to the roof deck in a known manner by spaced prior art deck fasteners. The membrane 10 is subject to severe wind loads from the ambient atmosphere. Therefore, it is required that the membrane be secured to the drain to preclude a wind load from lifting the membrane 10 at the drain 14, which lifting would otherwise destroy the deck protective function of the membrane. The adapter 2 serves to clamp the membrane 10 to the deck 12 about the drain 14 and to the drain 14.

The apron 4, FIG. 2, is a circular sheet material disk-like and washer-like in plan view with a central circular opening 30. The opening 30 is dimensioned to expose the drain bowl 16 to the ambient atmosphere. The apron 4 overlies the array of bosses 18 and flange surface 28 at its radial inner portion. An outer radial portion of the apron 4 is dimensioned to extend for a major portion beyond the outer perimeter of the flange 26, e.g., preferably about 60% of the apron radii between the opening 30 and its outer perimeter extends beyond the flange 26.

In FIG. 2*b*, the apron 4 comprises a central preferably sheet metal layer 32, e.g., stainless steel or aluminum, encased in an outer protective preferably thermoplastic coating or layer 34. For example, the coating may be PVC (polyvinylchloride) having a thickness of preferably at least 30 mils (0.030 inches). The metal layer 32 may have a thickness preferably in the range of about 0.015 to 0.032 inches. The apron 4 preferably has an outer diameter d' (FIG. 2) preferably in the range of about two to three feet. The flange 26 typically has a radial dimension d preferably in the range of about ¾ to 2½ inches.

The apron 4 is preferably formed with reinforcing ribs 42, FIGS. 1 and 2. The ribs 42 are circular segment depressions of like dimensions. The rib 42 depressions depend toward the deck 12. A pair of apertures 44 are formed in each depression for receiving screws 46. Screws 46 penetrate the membrane 10, FIG. 1, and attach the apron 4 to the deck 12 clamping the membrane 10 therebetween.

In FIG. 1, gasket 6 is formed with a lower surface 48 that is complementary with the upper stepped and inclined surface 28 formed by the flange 26 and bosses 18. The gasket 6 may be molded from rubber or other elastomeric composition with the desired surface configurations for mating with the drain 14 flange and bosses. Preferably, the apron 4 is bonded with any suitable adhesive to the gasket 6 to form a unitary gasket-apron assembly. The gasket may be fabricated, for example, from discarded automotive tires or other rubber products.

An annular array of bolt receiving bores 50 are formed in the gasket 6. These align with the threaded apertures 20 in the drain for receiving preferably stainless steel or bronze bolts 52. The gasket 6 has a circular inner edge 54 which is approximately coextensive with the inner surface of the array of bosses 18 but may be offset therefrom somewhat as shown. The gasket 6 is coextensive with the flange 26 outer circular edge 56.

An L-shaped circular ring 58, preferably cast iron, steel or non-ferrous metal, reinforces the assembly and is used to clamp the apron 4 at its inner peripheral region to the gasket 6 and the gasket in turn to the drain 14 via the bosses 18 and bolts 52. The ring 58 preferably is formed of a circular washer-like disk 60 and a circular upstanding leg 62 at a right angle to the disk 60. In the alternative, the leg 62 may be omitted and is optional. Such a ring may appear as shown in FIG. 1*a* at 64, which in this figure may also represent a circular washer. In the figures, spaces between abutting elements is shown for purposes of clarity of illustration. In practice, the abutting elements exhibit no clearance therebetween.

In operation, bolts and other components on a pre-existing drain 14 are removed. The membrane 10 is then installed about the drain 14 contiguous with the flange 26, FIG. 1. The membrane 10 may be bonded with a suitable adhesive to the apron 4 to form a water-impervious seal. Ring 58 is then clamped by bolts 52, clamping the apron 4 inner peripheral region and the compressible gasket 6 to the flange 26. Screws, or other fasteners are passed through the apertures 44 in the apron 44 and attached to the deck 12. The apron thus clamps the membrane 10 to the deck 12. The depression ribs 42 serve to provide clamping action on the membrane 10 about the drain flange 26, securing the membrane to the deck, an adhesive enhancing the securing action.

In a further alternative, in FIG. 1*a*, where identical reference numerals represent identical parts, in place of a ring 58, FIG. 1, circular metal washers 64 may be used. Washers 64 may be used with an apron of any material, but preferably one with a relatively stiff metal or other material core layer. These washers 64 would eliminate the need for the L-shaped ring 58.

In a further embodiment, the apron 4 may comprise a composite construction as shown by apron 4', FIG. 2*a*. Apron 4' may comprise a fiber or otherwise reinforced sheet of synthetic material such as thermoplastic, PVC and the like, polyamides such as Kevlar, carbon filled resin tapes or other carbon reinforced resins, and resins reinforced with fiber glass or other high strength fibers.

In FIG. 2*b*, annular radial arrays of reinforcing metal washer-like sheet rings 36 (one being shown) may be used encased in a thermoplastic outer layer 38. The rings 36 may be coplanar with, bonded to or embedded in an interior fiber reinforced layer 40. The apron 4' may be mold formed and the outer layer 34, FIG. 2*b*, maybe formed by any suitable coating process.

In a further embodiment, in FIG. 3, apron 68 of square peripheral shape may be used in the alternative to the circular apron 4 of FIG. 1. Apron 68 is constructed similarly as apron 4 as described above. Apron 68 has linear reinforcing depression ribs 70, one along each peripheral region. An array of four screw receiving apertures 72 are in each depression rib 70. Otherwise, the apron 68 is of identical construction materials as the apron 4. Of course, the apron may have any desired outer peripheral shape as may meet a given implementation. A major portion of the area of the apron 68 overlies the membrane 10 beyond the periphery of the drain 14 flange 26.

Gasket 66 has a lower surface complementary to and mating with the upper surface of the flange 26 and bosses 18. The gasket 66 is substantially the same as gasket 6, FIG. 1, except a washer-like sheet metal reinforcing ring 74 is molded into a recess in the upper surface 76 of the gasket 66.

It will occur to those of ordinary skill that various modifications may be made tot he disclosed embodiments. The description herein is intended to be illustrative and not limiting. The scope of the invention is as defined in the appended claims.

What is claimed is:

1. Drain adapter for a drain in a cementitious roof deck, said drain including an annular flange of a given exposed surface configuration surrounding a central drain opening and having an annular array of bolt receiving apertures in the flange, said deck including a flexible roofing membrane thereover surrounding and adjacent to the flange, said adapter comprising:

an annular compressible gasket having a first surface complementary to and for abutting engagement with said given exposed surface and a second surface distal the first surface;

an annular disk-like apron overlying and abutting the gasket second surface and extending radially outwardly from the gasket for overlying an annular portion of the membrane adjacent to the flange and gasket, the apron and the gasket for being clamped to the flange and the apron for clamping the membrane annular portion to the deck; and fastening means for securing the apron to said flange and to said deck in said overlying position relative to said gasket and relative to said annular portion of the membrane.

2. The adapter of claim 1 wherein the fastening means includes adhering means for bonding said apron to the gasket second surface.

3. The adapter of claim 1 including a plurality of annularly spaced reinforcing ribs in said apron.

4. The adapter of claim 3 wherein the ribs are depressions in said apron for receiving fasteners for attaching said apron to the roof deck and for clamping the membrane between the deck and apron.

5. The adapter of claim 1 including at least one reinforcing rib in said apron.

6. The adapter of claim 1 wherein the apron is sheet material with a central opening and is bonded to the gasket.

7. The adapter of claim 6 further including an annular ring for overlying said apron and said gasket adjacent to said opening, said fastener means including means for securing the ring in said overlying state.

8. The adapter of claim 7 wherein the fastener means includes a plurality of bolts, the ring, the gasket and the apron each having a plurality of annularly spaced aligned holes each for receiving a corresponding bolt for attachment to said drain aperture.

9. The adapter of claim 1 wherein said apron comprises sheet metal with an outer coating layer.

10. The adapter of claim 1 wherein the apron comprises sheet material and includes reinforcement means for forming reinforced non-metallic sheet material.

11. The adapter of claim 10 wherein the reinforcement means comprises a material selected from the group consisting of steel and aluminum sheet material rings and carbon, polyester and glass fibers.

12. The adapter of claim 1 further including an L-shaped metal ring for overlying the apron, gasket and flanges, said fastening means for securing the ring in said overlying relation.

13. The adapter of claim 1 wherein the apron is a square disk.

14. The adapter of claim 1 wherein the apron is circular disk.

15. The adapter of claim 1 wherein the gasket includes a metal reinforcement ring.

16. Drain adapter for a drain in a roof deck, said drain including an annular flange of a given exposed surface configuration surrounding a central drain opening and an array of annular bolt receiving apertures in the flange, said deck including a flexible roofing membrane thereover surrounding and adjacent to the flange, said adapter comprising:

an annular compressible gasket having a first surface complementary to and for abutting engagement with said given surface and a second surface distal the first surface;

an annular apron for overlying and in abutment with: 1) the gasket second surface and 2) a portion of the roof deck flexible membrane adjacent to the flange;

at least one reinforcing member;

a plurality of bolts mating with said apertures for securing the gasket, at least one reinforcing member and apron to the flange; and a plurality of fasteners for fastening said apron against the membrane and to the deck.

17. The adapter of claim 16 further wherein the at least one reinforcing member comprises a metal ring over the apron, gasket and flange, said ring for receiving said bolts.

18. The adapter of claim 17 wherein the ring is L-shaped in sectional view.

19. The adapter of claim 16 including means for bonding the apron to the underlying membrane and the gasket to the apron.

* * * * *